US006990831B2

(12) United States Patent
Fiene

(10) Patent No.: US 6,990,831 B2
(45) Date of Patent: Jan. 31, 2006

(54) SPLIT BEVERAGE COOLING COLLAR

(76) Inventor: Cory Fiene, 27766 Homestead Rd., Laguna Niguel, CA (US) 92677

( * ) Notice: Subject to any disclaimer, the term of this patent is extended or adjusted under 35 U.S.C. 154(b) by 0 days.

(21) Appl. No.: 10/831,403

(22) Filed: Apr. 23, 2004

(65) Prior Publication Data

US 2005/0235683 A1 Oct. 27, 2005

(51) Int. Cl.
*F25D 3/08* (2006.01)

(52) U.S. Cl. ..... 62/457.5; 62/457.1; 62/530

(58) Field of Classification Search ..... 62/371, 62/457.1, 457.2, 457.3, 457.4, 457.5, 530
See application file for complete search history.

(56) References Cited

U.S. PATENT DOCUMENTS 4,295,345 A * 10/1981 Atkinson ..... 62/371
4,802,602 A * 2/1989 Evans et al. ..... 220/739
4,955,516 A * 9/1990 Satterfield ..... 224/414
5,740,951 A * 4/1998 Jack ..... 224/148.3

* cited by examiner

*Primary Examiner*—Melvin Jones
(74) *Attorney, Agent, or Firm*—Rutan & Tucker, LLP

(57) ABSTRACT

A cooling collar for cooling beverages, comprising separable cooling shells that each contains a cooling material and a cavity that approximates the size of a standard beer or soda can. In preferred embodiments the cooling material is present in sufficient quantity to cool a standard beverage can from room temperature to about 45° F. in no more than 30, 25 or even 22 minutes, and to cool at least 24, 35 or even 50 cans without refreezing the collar.

19 Claims, 1 Drawing Sheet

FIG. 1
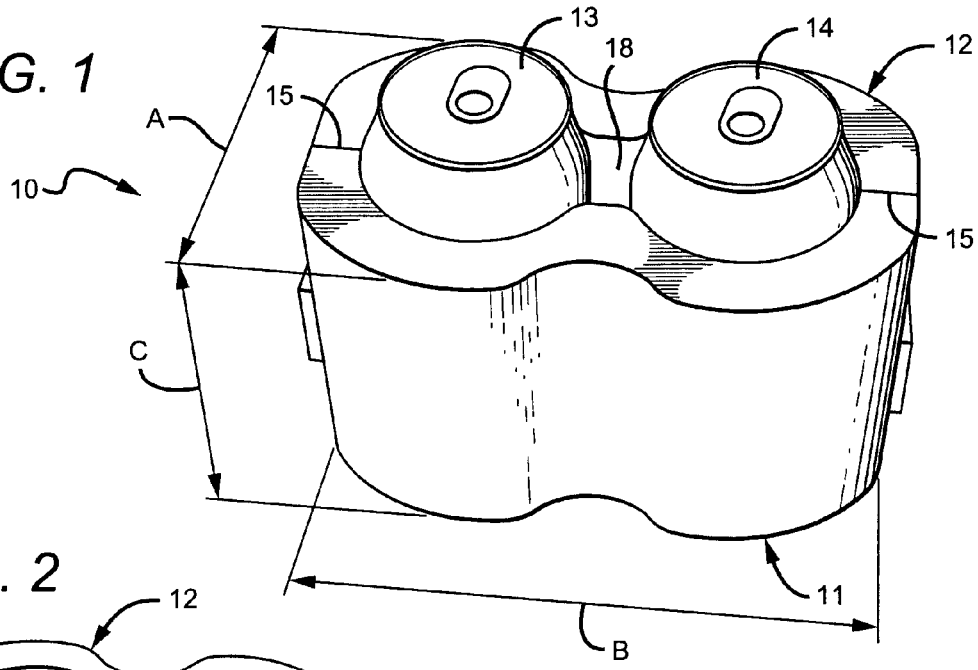
FIG. 2
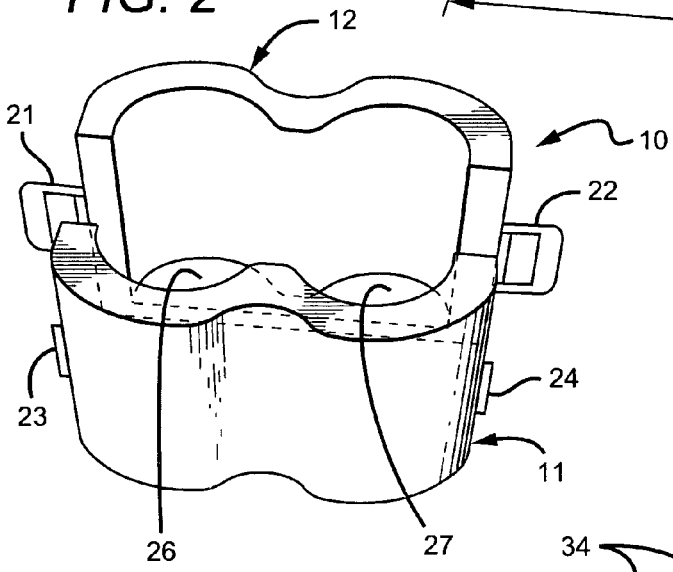
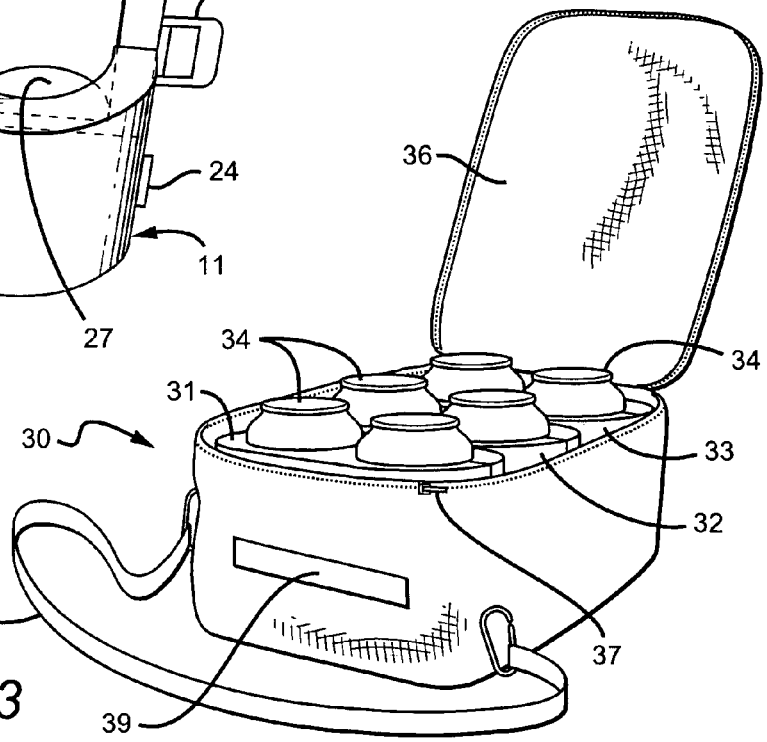
FIG. 3

SPLIT BEVERAGE COOLING COLLAR

FIELD OF THE INVENTION

The present invention relates generally to portable beverage chillers and chillers.

BACKGROUND OF THE INVENTION

Styrofoam and other insulating coolers are well known for maintaining temperature of beverages and food. The typical configuration is to provide a substantially closed container having four walls, a floor, and a lid. Frequently, ice is also placed into the storage area to help keep the beverages and food cold.

It is also known to use eutectic solutions such as Blue Ice™ to keep the items within a cooler cold. Eutectic solutions have a much greater ability to absorb heat than does ice. A container of Blue Ice™ or other freezable material may be cooled to a temperature near or below the freezing point of water in a home freezer, and then used to cool the contents of a cooler.

Although merely placing a container of freezing material into a cooler is generally adequate for keeping beverages and food items cold, such practice is inadequate for rapidly cooling beverages. Among other things, the cooling material is typically formed as a large block, and does not have sufficient contact with a beverage to rapidly reduce the temperature of the beverage. Cooling material is sometimes placed within a foldable jacket, which could conceivably be wrapped about a beverage can. See e.g., PCT patent application number PCT/US01/43507. But since the jackets are normally flat, folding them around a container as small as a beverage container provides only a few lines of contact with the can, rather than larger surfaces. Moreover, known jackets are undesirably bulky, prone to punctures, and unworkable in many ways.

It is possible to construct a cooling chamber that is sized and dimensioned to provide broad contact with a soda, beer, water, or other small beverage container. But such chambers would be too large to conveniently fit inside the freezer portion of a typical home refrigerator. Furthermore, when a cooling chamber is configured such that it generally surrounds a beverage container, so as to be in intimate contact therewith, it may be difficult to remove the beverage container from the chamber. This problem may be exacerbated by thermal contraction and/or thermal expansion that occur during the cooling and warming processes.

In view of the foregoing, it is desirable to provide a beverage cooler that is configured to be in intimate contact with one or more beverages so as to rapidly cool the beverages and which, at least in some configurations, has a size (such as an opened or disassembled size) that is smaller than its size when it is being used to cool the beverage(s), such that the beverage cooler can easily fit within a home freezer. It is further desirable to provide a beverage cooler that facilitates easy removal of the beverage container therefrom.

SUMMARY OF THE INVENTION

According to one aspect of the present invention, an improved beverage cooler is provided wherein a cooling collar comprises a cooling material having at least one split that facilitates reconfiguration of the cooling collar such that at least one dimension, such as the width, is reduced. By reducing at least one dimension of the cooling collar, the cooling collar can more easily be placed within a freezer so as to effect cooling.

The split need not necessarily extend completely through the cooling material, but rather extends sufficiently therethrough so as to facilitate reconfiguration of the cooling collar and/or facilitate easy removal of beverage containers therefrom. For example, a partial split that extends through only a portion of the cooling material, and thus does not separate the cooling material into two portions, may allow the cooling collar to be bent or otherwise deformed so as to facilitate a reconfiguration that allows the cooling collar to be more easily stored and/or allows beverage containers to be more easily removed therefrom.

Further, more than one split or partial split or any desired combination of splits and partial splits may be utilized.

The split also preferably facilitates biasing of the cooling collar against the beverage container, so as to provide more intimate contact therewith and so as to consequently enhance heat transfer from the beverage to the cooling material. That is, the split preferably defines a gap between two or more portions of the cooling collar such that biasing the portions of the cooling collar toward one another causes them to grip and intimately contact the beverage container.

Latches or other links preferably bias portions of the cooling collar toward one another, so as to provide intimate contact with a beverage container. The links may thus comprise, for example, an elastomeric material that stretches when the cooling collar surrounds a beverage container, so as to provide a biasing force. Preferably, these are the same latches or links that attach separate portions of the cooling collar to one another.

According to another aspect, the present invention comprises a cooling collar comprising a first portion and a second portion. The first portion and the second portion are comprised of a cooling material. The first portion and the second portion cooperate with one another so as to at least partially enclose at least one beverage container.

The first and second portions of the cooling collar may be placed in a storage container, such as a freezer, in a stacked configuration, side-by-side, apart from one another in different portions of the freezer, or in any other desired fashion. Thus, the use of smaller freezers or refrigerators, as well as the use of crowded freezers or refrigerators, is facilitated.

Preferably, the first portion and the second portions comprise a polymer container within which is disposed a eutectic substance. A preferred polymer is a blow molded polyethylene. A preferred eutectic substance comprises gel crystals from Northwest Gel, Inc. (http://www. northwestgel.com), or some other nontoxic substance having a very high heat capacity. Blue Ice™ is not particularly desirable because of its toxic composition. However, those skilled in the art will appreciate that various other cooling materials, particularly high heat capacity materials, are likewise suitable. For example, the first portion and the second portion may alternatively comprise a metal.

Preferably, the first portion is completely separable from and attachable to the second portion, such as via the use of latches. Alternatively, the first portion may be hingedly attached to the second portion, such as via the use of a living hinge.

Any desired combination of latches and hinges may be used. For example, hinges may be used to attach the first portion to the second portion on one side of the cooling collar and latches may be used to attach the first portion to the second portion on the other side of the collar. In this manner, the cooling collar may be configured to open and close in the fashion of a common suitcase.

Preferably, the first portion is substantially identical to the second portion, so as to reduce manufacturing costs. For example, if both the first portion and the second portion are made from the same mold, then manufacturing costs are reduced since two separated molds (one for each portion) are not needed.

Preferably, the first portion and the second portions conform generally to a contour of the beverage container(s). In this manner, more intimate contact between the cooling collar and the beverage container is maintained.

Preferably, the first portion and the second portion have a thickness of between approximately 0.25 inch and approximately 2 inches. For example, the first portion and the second portion may have a thickness of approximately 0.75 inch. In this manner, sufficient thickness of the container of the eutectic substance is provided such that enough eutectic substance is contained therein so as to assure desired cooling of the beverage. Further, the cooling collar is thus maintained at an acceptably small size such that it can readily be carried and stored.

The cooling collar of the present invention may be configured to cool a single beverage. Alternatively, the cooling collar may be configured to cool two, four, six, eight or more beverages. Indeed, the first portion and the second portion may cooperate to at least partially enclose any desired number of beverage containers and the present invention may thus be configured to cool any desired number of beverages.

The cooling collar of the present invention optionally comprises a bottom, so as to enhance contact with a beverage container enclosed thereby. The bottom may be formed in the first portion, the second portion, or both.

Preferably, the bottom is formed partially to the first portion and partially to the second portion. That is, preferably one half of the bottom is formed to the first portion and one half of the bottom is formed to the second portion, such that the first and second portions are substantially identical to one another and manufacturing costs tend to be minimized, as discussed above.

According to one embodiment, the first portion and the second portion are shaped so as to at least partially enclose a wine bottle. According to another embodiment, the first portion and the second portion are shaped so as to at least partially enclose a beer bottle. According to yet another embodiment, the first portion and the second portion are shaped so as to at least partially enclose a soft drink can.

Those skilled in the art will appreciate that various other configurations of the cooling collar of the present invention are likewise suitable. The first portion and the second portion may alternatively be configured so as to at least partially enclose a variety of other food items, as well as non-food items. For example, the first portion and the second portion may be configured to at least partially enclose a sandwich, so as too keep the sandwich cool. As a further example, the first portion and the second portion may be configured so as to as least partially enclose a container of medicine.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1 is perspective view of an exemplary embodiment of the split beverage cooling collar of the present invention that is configured to cool two standard twelve ounce (355 ml) canned soft drinks, showing the two canned soft drinks disposed therein;

FIG. 2 is a perspective view of the split cooler of FIG. 1, showing the soft drinks removed therefrom and showing the two halves separated from one another; and FIG. 3 is a perspective view of three of the split coolers of FIG. 1, showing the three split coolers disposed within a carrying case such that six canned soft drinks can conveniently be cooled and carried.

DETAILED DESCRIPTION

Referring now to FIG. 1, a cooling collar 10 is configured to partially enclose two soft drink containers 13, 14. The cooling collar 10 has an overall width of approximately 3.5 inches, as indicated by dimension A, an overall length of approximately 6.5 inches, as indicated by dimension B, and an overall height of approximately 4.5 inches, as indicated by dimension C. Those skilled in the art will appreciate that other dimensions of the cooling collar 10 are likewise suitable.

As mentioned above, the cooling collar 10 may be configured so as to at least partially enclose and cool any other desired number of beverages. Indeed, various configuration of such multiple container cooling collars are contemplated. For example, a cooling collar that is configured to cool six soft drinks may be arranged linearly, as is the cooling collar 10 of FIG. 1, or may alternatively be arranged such that the soft drinks form two rows of three soft drinks each, in the fashion of a contemporary six pack. Alternatively, a plurality of separate cooling collars that are configured to cool two beverages each as shown in FIG. 1 may be ganged or used together so as to cool more than two beverages as shown in FIG. 3 and discussed in detail below.

The cooling collar 10 generally comprises a first portion 11 and a second portion 12 that cooperate to at least partially enclose beverage containers 13 and 14. A split 15 separates the first portion 11 from the second portion 12.

The first portion 11 and the second portion 12 comprise containers that contain a eutectic substance such as gel crystals from Northwest Gel, Inc. (poly (sodium acrylate) homopolymer or sodium salt of polyacrylic acid, CAS # 9033-79-8). The eutectic substance cools the beverages contained within the beverage containers 13 and 14 according to well know principles.

As used herein, the term "eutectic substance" is defined to include any substance that may itself be cooled, and then used to cool beverages. Typically, a eutectic substance absorbs a substantial amount of heat and does not change much in temperature, as its state changes from solid or partially solid to substance. Examples of such eutectic substances include solutions of brine or glycol that have a melting point in the range of −60° F. to 32° F. (−50° C. to 0° C.). Preferably, a non-toxic, non-staining, water based eutectic substance is used.

Such eutectic substance cooling materials as gel crystals from Northwest Gel, Inc. are typically used by placing them in the freezer compartment of a home refrigerator until they have been cooled down to approximately the temperature of the freezer compartment and them placing the cooling material into proximity with a food item to be kept cool. The cooling material then absorbs heat from the food item so as to maintain the food item at a desirably low temperature, generally to inhibit spoilage.

The first portion 11 and the second portion 12 are preferably formed of a strong, relatively inexpensive, and relatively heat conducting polymer material such as polyethylene, or less preferably a material such as acrylonitrile butadiene styrene (ABS). Those skilled in the art will appreciate that various other materials, including metals such as steel and aluminum and including composite materials such as fiberglass and Kevlar, are likewise suitable.

The first and second portions 11, 12 of cooling collar 10 may be formed by any desired process, such as blow molding, or rotary molding, and so forth.

Preferably, the first portion 11 and the second portion 12 conform generally to the contour of beverage containers enclosed thereby. Thus, intimate contact with the beverage containers is provided and cooling of the beverages is enhanced. Preferably, some portion of each beverage container 13 and 14 extends above the first portion 11 and the second portion 12 and/or a void 18 is provided intermediate the beverage containers 13 and 14, so as to facilitate easy removal of the beverage containers from the cooling collar 10 without having to separate the first portion 11 and the second portion 12 from one another.

Referring now to FIG. 2, the first portion 11 is separable from the second portion 12. Such separation reduces the overall width (dimension A of FIG. 1) to approximately one half of its value when the two portions are attached to one another, so as to facilitate storage of the cooling collar 10 in places where it may otherwise be to wide. Thus, if the overall width (dimension A) is 3.5 inches when the two portions are attached to one another, then the width of each separate portion will be approximately 1.75 inch. On many occasions, it may be easier to find storage space for two separate items having a width of 1.75 inch each than it is to find storage space for a single item having an overall width of 3.5 inches.

For example, after the first portion 11 and the second portion 12 are separated from one another, the cooling collar may be stored in a freezer compartment that is two small and/or two crowded to store the cooling collar in with the first portion 11 and the second portion 12 attached to one another.

Separation of the first portion 11 from the second portion 12 also facilitates easy removal of the beverage containers from the cooling collar. Thus, if the cooling container grips a beverage container too tightly and it cannot easily be removed from the cooling collar while the first portion 11 is attached to the second portion, then the first portion may be removed from the second portion and the beverage container can then be easily removed.

Optionally, the cooling collar comprises a bottom. For example each of the first portion 11 and the second portion 12 may comprise one half of a bottom 26 and 27 for each beverage container to be enclosed thereby.

The first portion 11 and the second portion 12 are preferably attachable to one another so as to define the cooling collar of the present invention. Alternatively, the first portion 11 and the second portion 12 may held in place by a case, box, or other enclosure such as that shown in FIG. 3 without be attached to one another. Of course, the first portion 11 and the second portion 12 may be attached to one another even though they are disposed within a container that would otherwise hold them in place.

The first portion 11 and the second portion 12 may be attached to one another by any desired means. For example, latches 21 and 22 may be formed upon one portion and catches 23 and 24 may be formed upon the other portion, so as to attach the two portions together according to well know principles. Optionally, each portion may comprise one latch and one catch, such that the two portions are substantially identical as discussed above.

Preferably, the latches 21 and 22 comprise a stretchable or elastomeric material that biases the first portion 11 and the second portion 12 toward one another when a beverage container is placed into the cooling collar.

Referring now to FIG. 3, one or more of the cooling collars of the present invention may be disposed within a case 30 so as to facilitate transportation and storage of beverages while the beverages are being cooled. Any desired number of such cooling collars may be disposed within such a case and each cooling collar may be configured to cool any desired number of beverages 34.

The case 30 is preferably insulated, so as to inhibit heat flow into the beverages and thus more quickly cool the beverages and better maintain a desired cool temperature of the beverages. In the embodiment shown, case 30 comprises a lid 36 that can be opened, such as via zipper 37. Various means other than a zipper for securing the lid 36 in the closed position are contemplated. The case 30 may optionally comprise a carrying strap 38 and/or a handle 39 so as to facilitate easy carrying. Larger cases may further comprise wheels, if desired.

Having thus described the structure of preferred split beverage cooling collars, it may be beneficial to describe preferred uses. In use, the first portion 11 may be separated from the second portion 12, such as by unlatching the latches 21 and 22 from the catches 23 and 24. The separated first portion 11 and second portion 12 are smaller than the two combine portions and it may thus be substantially easier to find space in a freezer for the two separated portions than for the same two portions when they are attached to one another.

After the first portion 11 and the second portion 12 have been in the freezer long enough to have reached a desired temperature, they are removed from the freezer and reattached to one another via the latches 21 and 22, if necessary. One or more beverage containers 13 and 14 may then be placed into the cooling collar as shown in FIG. 1.

If desired, one or more cooling collars of the present invention may be placed into a common container, such as that shown in FIG. 3.

Because the cooling collar of the present invention contacts a substantial portion of the surface area of each beverage container, heat transfer from the beverages is enhanced. This enhanced heat transfer facilitates more rapid cooling of warm beverages. It also facilitates longer and more reliable maintenance of a desired cool temperate of the beverages after they have been cooled. The cooling capacity of preferred embodiments is substantial. Repeated tests have shown that commercial versions of the present invention can cool cans of beer or soda from room temperature to drinking temperature of about 45° F. in no more than about 35, 30, 25 or even 22 minutes, and that a six pack collar can repeat the cooling on up to 12, 18, 24, 35 or even 50 cans without refreezing the collar.

Beverage containers can be removed from the cooling collar by simply grasping the top of the beverage container and pulling it from the cooling collar, taking advantage of the void 18 for better grip on the beverage container, if desired. If the beverage container does not come out of the cooling collar easily, then the two portions of the cooling collar may be separated from one another to facilitate removal of the beverage container, as described in detail above.

Although the cooling collar of the present invention is illustrated and described above as being split vertically, those skilled in the art will appreciate that the cooling collar may be split horizontally, diagonally, at any desired angle, or in any desired manner.

Further, although only a single split is illustrated and described above, those skilled in the art will appreciate that two or more splits may be utilized. Thus, any desired number of splits in any desired configuration may be utilized so as to reduce at least one dimension of the cooling collar of the present invention and thus make it easier to fit into a confined space, such as a freezer compartment, and/or so as to facilitate easy removal of beverages from the cooling collar.

Thus, specific embodiments and applications of the split beverage cooler have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A cooling collar for cooling a beverage in a beverage container, the cooling collar comprising a cooling material, and having at least one split formed therein that facilitates reconfiguration by which at least one dimension of the cooling collar is reduced, wherein the split cuts across an end of the beverage container.

2. The cooling collar of claim 1, wherein the split defines first and second portions that enclose the cooling material.

3. The cooling collar of claim 2, where at least one of the first and second portions includes a cavity that conforms to an external shape of a standard beer or soda can.

4. The cooling collar of claim 3, wherein at least one of the first and second portions comprises a polyethylene shell.

5. The cooling collar of claim 3, wherein the cooling material comprises eutectic gel crystals.

6. A cooling collar for cooling beverages, the cooling collar comprising a cooling material, and having at least one split formed therein that facilitates reconfiguration by which at least one dimension of the cooling collar is reduced; wherein at least one of the first and second portions includes a cavity that conforms to an external shape of a standard beer or soda can; and wherein the first portion is coupled to the second portion via a hinge.

7. The cooling collar of claim 3, wherein the first portion is attachable to the second portion via a latch.

8. The cooling collar of claim 3, wherein the first portion has an overall shape that is substantially identical to the second portion.

9. The cooling collar of claim 3, wherein the first portion and the second portions have a thickness between outer and inner walls of between approximately 0.25 inch and approximately 1 inch.

10. The cooling collar of claim 3, wherein the first portion and the second portion have a thickness between outer and inner walls of approximately 0.75 inch.

11. The cooling collar of claim 2, wherein the first portion and the second portion cooperate to at least partially enclose a plurality of beverage containers.

12. The cooling collar of claim 2, wherein the first portion and the second portion cooperate to at least partially enclose 2 beverage containers.

13. The cooling collar of claim 2, wherein the first portion and the second portion cooperate to at least partially enclose 4 beverage containers.

14. The cooling collar of claim 2, wherein the first portion and the second portion cooperate to at least partially enclose 6 beverage containers.

15. The cooling collar of claim 2, wherein the first portion and the second portion cooperate to at least partially enclose 8 beverage containers.

16. A cooling collar for cooling beverages, the cooling collar comprising a cooling material, and having at least one split formed therein that facilitates reconfiguration by which at least one dimension of the cooling collar is reduced, wherein the split defines first and second portions that enclose the cooling material, and wherein the cooling material is present in sufficient quantity to cool a standard beverage can from room temperature to about 45° F. in no more than 30 minutes.

17. The cooling collar of claim 2, wherein the cooling material is present in sufficient quantity to cool a standard beverage can from room temperature to about 45° F. in no more than 25 minutes.

18. The cooling collar of claim 2, wherein the cooling material is present in sufficient quantity to cool at least 24 standard beverage cans from room temperature to about 45° F. without refreezing the collar.

19. The cooling collar of claim 2, wherein the cooling material is present in sufficient quantity to cool at least 35 standard beverage cans from room temperature to about 45° F. without refreezing the collar.

* * * * *